United States Patent [19]

Essig

[11] Patent Number: 4,516,412

[45] Date of Patent: May 14, 1985

[54] CAMBOX FOR A FLAT KNITTING MACHINE

[75] Inventor: Karl Essig, Gaienhofen, Fed. Rep. of Germany

[73] Assignee: H. Stoll GmbH & Co., Reutlingen, Fed. Rep. of Germany

[21] Appl. No.: 429,197

[22] Filed: Sep. 30, 1982

[30] Foreign Application Priority Data

Nov. 1, 1981 [DE] Fed. Rep. of Germany ..... 3144246

[51] Int. Cl.[3] ..... D04B 7/00

[52] U.S. Cl. ..... 66/78; 66/75.1

[58] Field of Search ..... 66/78, 75.2, 75.1

[56] References Cited

U.S. PATENT DOCUMENTS 3,007,324 11/1961 Bram ..... 66/75.1 X
3,693,377 9/1972 Hadam ..... 66/78
3,748,873 7/1973 Nakane et al. ..... 66/78 R
3,955,381 5/1976 Panchaud ..... 66/75.1

FOREIGN PATENT DOCUMENTS 878289 1/1943 France ..... 66/75.1

*Primary Examiner*—Ronald Feldbaum
*Attorney, Agent, or Firm*—Larson and Taylor

[57] ABSTRACT

The invention is concerned with a knitting cambox system for a flat knitting machine with front and rear needle beds arranged gable-fashion and adapted for the production of multicolor knitted fabric a single pass of the machine carriage.

An improvement is achieved in this invention by the interassociation of a plurality of independently-operable needle sinkers at the two sides of the knitting cambox so as to provide a timewise-staggered drawing-down of the stitches and increased stitch production.

2 Claims, 2 Drawing Figures

12
11
13
14
14'
15
15'
16
16'
17
17'
21
22
23
23'
24
24'
25
25'
26
26'
28
I
II
III
I II III 18
19
20

CAMBOX FOR A FLAT KNITTING MACHINE

This invention relates to a cambox for a flat knitting machine adapted to produce multicolour knitted fabric during a single pass of the machine carriage.

The production of multicolour knitted fabric is nearly always dependent on the number of the camboxes and the number of available yarn guides and for this reason the colour combination of the fabrics which can be produced economically is considerably restricted. The control of the laying-in of the yarn and thus the multicolour production of knitted products is afforded by the cambox construction of the present invention.

Hitherto flat knitting machines of standard type have been used to make the knitted products of the kind under discussion. Because of a limited number of available yarn guides and the enforced combination of cambox and colour-dependent yarn guides the production per cambox-type and pattern can be greatly limited.

A further means of producing multicolour fabrics in one machine pass is described in DE-PS No. 99402. Using a presser cam part technique operated by a kind of Jacquard the needles are pattern-selected and, to form colour stitches, are introduced through three separate cam tracks of a timewise-staggered yarn-input arrangement thereafter to be drawn in together by a needle sinker-like part. The drawback of this arrangement, which incidentally fails to allow any very accurate placing of the colour stitches, is exhibited by typically poor pattern-adherence of the Jacquard knit.

The object of the present invention is to provide a knitting cambox by means of which stitches for multicolour fabrics can be produced using a minimum of space.

This is achieved in the present invention by the fact that a plurality of needle sinkers operable independently of one another are associated together at the two sides of the loop tuck cambox and that the control of the knitting elements is performed by presser cam parts which are pre-selected by electromagnetically-operated preselection systems arranged in advance of the knitting cambox.

An embodiment by way of example of the knitting cambox of this invention will now be described with reference to the accompanying diagrammatic drawings, in which.

Figure 1:
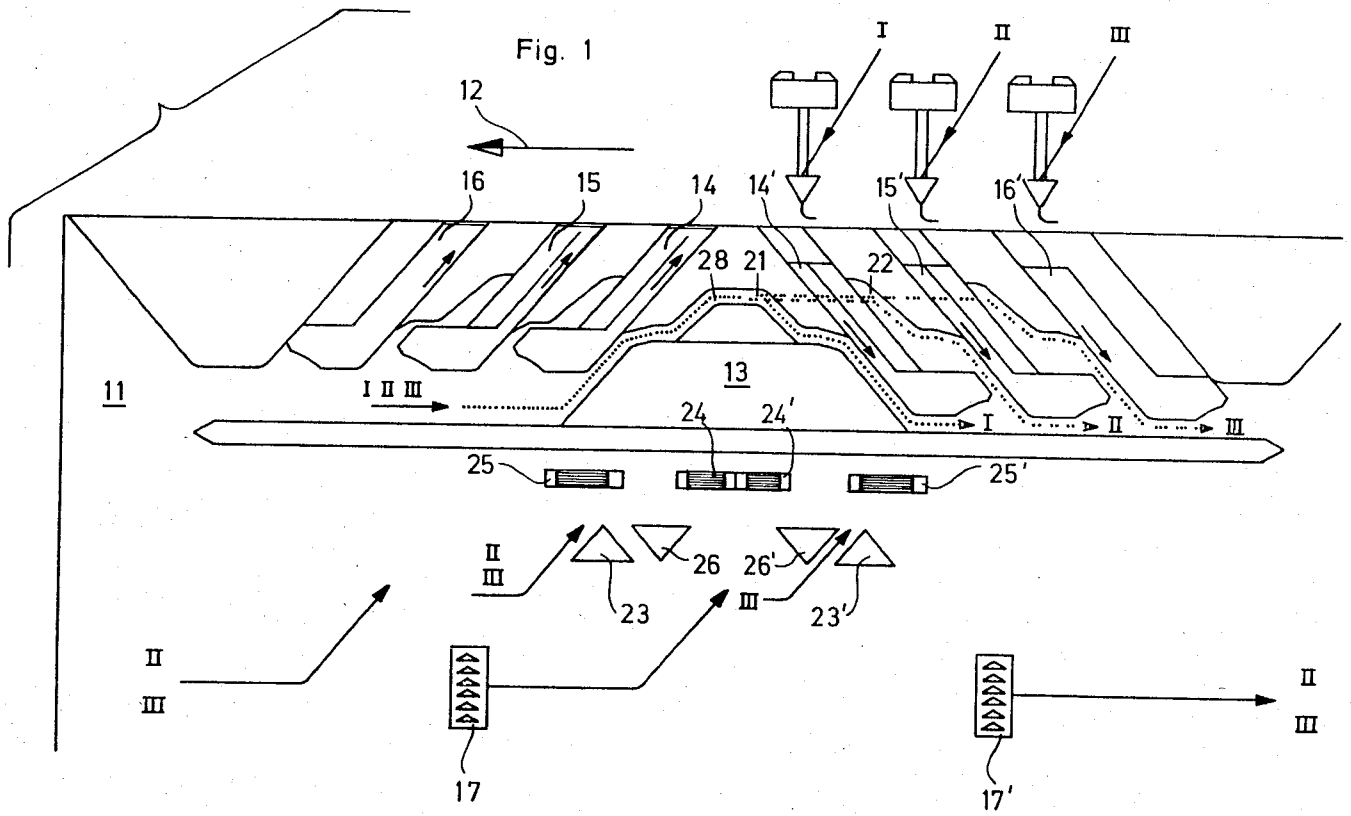
FIG. 1 is a diagrammatic plan view of the cambox layout of the flat knitting machine.
Figure 2:
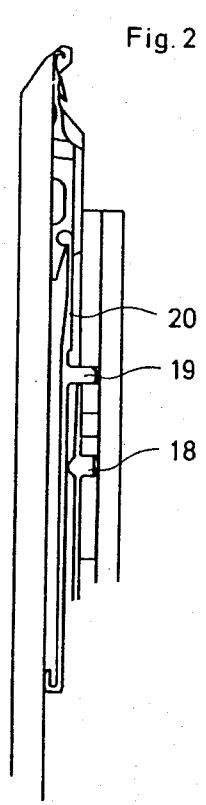
FIG. 2 is a partial cross-section along a needle trick of a single needle bed.

FIG. 1 is a diagrammatic plan view of the front plate 11 of the cambox to which conventional control studs are attached. The arrow 12 at the upper part of the drawing shows the direction of travel of the cambox 13 which is thus the direction of travel of the carriage which moves over the needles or over the needle beds. Advantageously, the construction of the "loop-trapper knitting cam assembly", which is conventional and is referred to as a cambox for short, is, in a flat bar knitting machine, symmetrical. Because the overall construction of the cambox 13 is conventional further description thereof is unnecessary. What are important to the invention are the two sets of three stitch cams or needle sinkers 14, 15, 16 and 14', 15', 16' which are used with the cambox 13 and the usual purpose of which is to vary the flare length of the loops to be knitted. These stitch cams enable one to work with, as required, three different colors and loop adjustments and this is symbolized by the three notional, substantially reduced yarn guides I, II, III depicted above the cam pattern and shown in their standard inserting positions. The first to move are the three stitch cams or needle sinkers 14, 15, 16 which are initially placed in an upper position, as indicated by the arrows in FIG. 1, in which they do not engage the needle butts located therebelow and thus are not in action. The next adjacent stitch cams or needle sinkers 14', 15', 16' are individually programmed for movement by a control system (not shown here), either mechanically or by means of an electric motor, to their loop sinking position following stroke reversal and can be individully controlled in their working or operative position. The pattern selection is effected in each case by means of an electromagnetic selector system 17, 17' arranged in advance of the knitting cambox 13. The selector system 17, 17' operates the selector sinker (not shown) in dependence upon the direction of the stroke which, in consequence, acts on the needle butt 18 and lifts the same into the operating position by means of driving members 23, 23' so that the needle butt or pusher 18 is brought into the path of the controllable presser cam parts 24, 24' and 25, 25'. It will be understood that the selector system and the selector sinkers themselves can be of a conventional construction and thus any further description thereof is not deemed to be necessary.

Selected needles of colour I guided in the usual way are moved by the needle shanks or jacks 20 through the cambox channels 28 and drawn down or sunk by the stitch cams or needle sinkers 14'. During this performance the presser parts 24 to 25' are completely out of action, i.e., presser cam parts 24 to 25' are positioned so that they do not project beyond the surface of the cam plate and thus do not engage or control the jack-selector butts.

Needles and needle shanks 20 of colour II moved in the same way as in the case of colour I through the cambox channel 28. In a parallel fashion, by programmed pre-selection by the selector system 17', the needle abutments 18 are brought by the actuating parts into the path of the moving cambox parts 24 and 25'. The butt 19 of the needle shank or jack 20 is now pressed by the needle abutment or pusher 18 through the presser part 24' out of the needle channel 28 in the area of the marking 21 and, after passing of the needle abutment over the presser cambox part 24', is again released into the needle channel for drawing-down of the knitted stitch of colour II with the stitch cam or needle sinker 15'. The needle butt now follows a two-point pattern.

Needles and needle shanks 20 of colour III move through channel 28 as in the case of colour I. In parallel with this the needle abutments 18 are moved out, i.e., lifted over the driving member 23' into the path of the operative presser cam parts 24 to 25' by the programmed pre-selection mechanism 17'. As the case of colour II the needle abutment 19 is pressed out of the needle channel 28 at marking 21. The needle abutments are now returned to the selection position by the retracting part 26, 26'. This is followed by an additional pre-selection by the selector system 17 with the result that the needle channel at marking 22 and after the ensuing release, can only be re-engaged by the needle sinker 16' to draw down colour III into the knitted stitch.

I claim:

1. A cambox for a flat knitting machine adapted to produce single needle bed, multicolor knitting patterns during a single pass of the machine carriage characterized by the provision of a plurality of stitch cams operable independently of one another and associated together at the two sides of the cambox and control means for providing independent movement of said stitch cams and of selected needles carrying yarns of at least three different colors such that needles carrying a first color yarn are caused to travel through a needle guide track of the cambox and to be drawn down by a first stitch cam to provide a knitted stitch of the first color, such that needles carrying a second color yarn are caused to travel through the needle guide track along a second path in which the needles are held out of the guide track of the cambox at a first point corresponding to the point of which the needles carrying the first color yarn are drawn down by the first stitch cam and thereafter are subsequently released into the guide track of the cambox so as to enable drawing down of a knitted stitch of the second color by a second, laterally spaced stitch cam, and such that needles carrying a third color yarn are caused to travel along a third path wherein the needles are held out of the needle guide track at said first point and at a further point corresponding to the point at which the needles carrying the second color yarn are released, and thereafter are subsequently released into the guide track of the cambox so as to enable drawing down of a knitted stitch of the third color by a third stitch cam spaced laterally from said second stitch cam.

2. A cambox according to claim 1, characterized by the fact that presser cam parts are provided to operate the knitting elements.

* * * * *